US006206816B1

(12) United States Patent
Cook et al.

(10) Patent No.: US 6,206,816 B1
(45) Date of Patent: Mar. 27, 2001

(54) METHOD FOR INVERTING A FOLDED COLLATION

(75) Inventors: Graham T. Cook, Harlow Essex; Richard A. Baker, Bishops Stortford; David J. Ricketts, Braintree Essex, all of (GB)

(73) Assignee: Pitney Bowes, Inc., Stamford, CT (US)

( * ) Notice: Subject to any disclaimer, the term of this patent is extended or adjusted under 35 U.S.C. 154(b) by 0 days.

(21) Appl. No.: 09/274,045

(22) Filed: Mar. 22, 1999

(51) Int. Cl.[7] ..... B31F 1/00

(52) U.S. Cl. ..... 493/420; 493/69; 493/79; 493/151; 493/419; 493/478

(58) Field of Search ..... 493/23, 68, 69, 493/79, 125, 151, 162, 254, 405, 442, 421, 476, 29, 249, 231, 274, 257, 419, 420, 475, 479, 3, 8

(56) References Cited

U.S. PATENT DOCUMENTS 5,092,832 * 3/1992 Crowley ..... 493/421
5,352,177 * 10/1994 Walter ..... 493/23
5,683,338 * 11/1997 Krasuski et al. ..... 493/23
5,769,774 * 6/1998 Beck et al. ..... 493/421
5,871,433 * 2/1999 Lehmann et al. ..... 493/420
5,980,439 * 11/1999 Johnson et al. ..... 493/421

* cited by examiner

*Primary Examiner*—Stephen F. Gerrity
*Assistant Examiner*—Sam Tawfik
(74) *Attorney, Agent, or Firm*—Christopher J. Capelli; Michael E. Melton

(57) ABSTRACT

A method is disclosed for processing a collation in a folding station (100) having a folding roller assembly (106, 108, 110, 112), a first fold plate assembly (102) and a second fold plate assembly (104) downstream of the folding roller assembly and the first fold plate assembly. The second fold plate assembly includes a stop member (126) movable at least between a distal position away from the folding roller assembly and a proximal position in proximity to the folding roller assembly. A portion of the collation is first conveyed into the first fold plate assembly (102) and the collation is then conveyed from the first fold plate assembly, through the folding roller assembly, and into the second fold plate assembly. Once in the second folding plate assembly the collation abuts against the stop member, whereafter the stop member (126) is moved from its distal position to its proximal position so as to cause the collation to convey out of the second fold plate assembly (104).

5 Claims, 7 Drawing Sheets

METHOD FOR INVERTING A FOLDED COLLATION

FIELD OF THE INVENTION

The present invention relates generally to document inserting systems, which assemble documents and inserts for insertion into envelopes. More particularly, the present invention is directed toward a method for inverting a half-folded document in an inserter system.

BACKGROUND OF THE INVENTION

Document inserting systems generally include a plurality of various stations that are each configured for a specific task. For instance, an inserter system typically includes at least one sheet feeding mechanism for supplying a sheet from a supply. Preferably an inserter system includes a collating mechanism located downstream of the sheet feeding mechanism that is functional to collate one or more sheets designated to be inserted into an envelope. A folding mechanism is usually located downstream of the collating mechanism and is operational to fold the sheet collation in a prescribed format. Examples of such folded formats include a z-fold, a c-fold, a half-fold, double-fold, etc. An insertion station is typically located downstream of the folding mechanism and is operational to insert the folded collation into a waiting open envelope.

Inserter systems are used by organizations such as banks, insurance companies and utility companies for producing a large volume of specific mailings where the contents of each mail item are directed to a particular addressee. Additionally, other organizations, such as direct mailers, use inserts for producing a large volume of generic mailings where the contents of each mail item are substantially identical for each addressee. Examples of such high volume inserter systems are the 8, 9 and 14 series inserter systems available from Pitney Bowes, Inc., Stamford, Conn.

However, inserter systems are not limited to such high volume applications as they also have considerably utility in lower volume applications, such as SOHO (small office/home office) applications. An example of such a SOHO inserter system is the tabletop 3 Series inserter system available from Pitney Bowes Limited, Harlow, England. This inserter system has been designed for implementation on an tabletop surface while providing many automated features and requiring little maintenance. In other words, it has been designed to be operated by an ordinary office worker with little or no training in operating inserter systems. Therefore, regarding the operation of such inserters, it is critical that they provide many automated and self adjusting features while having a high degree of reliability. One such area of an inserter where automation and reliability is extremely important is the folding station.

A known difficulty associated with folding stations is when it desired to invert the travel direction of a half-folded collation in the folding station of an inserter. It is desirable to invert the travel direction of a half-folded collation (also known as a single-folded document) when it is required reorient the addressing text printed on a sheet so as to be properly orient that text with respect to an envelope window when inserted therein. In the prior art, a spring loaded stop was implemented in one of the folding plates to effect the change of direction of a half-folded document. However, it has been found that such spring loaded stops are costly as they require added structure and often prove unreliably.

Therefore it is an object of the present invention to overcome the difficulties associated with folding stations for inverting the travel direction of a half-folded collation in the folding station of an inserter system.

SUMMARY OF THE INVENTION

Accordingly, the instant invention provides a folding station in an inserter system that overcomes the known difficulties associated with inverting the travel direction of a collation in a folding station. In accordance with a preferred embodiment, a method is set forth for inverting the travel direction of a half-folded collation in a folding station which includes the steps of providing a stop member in the second fold plate assembly that is movable between a distal position away from the folding roller assembly and a proximal in proximity to the folding roller assembly and a control system coupled to the stop member in the second fold plate assembly and operative to move the stop member between its distal and proximal positions.

A collation is initially conveyed to the first fold plate assembly such that a leading edge portion of the collation is disposed in the first fold plate assembly and a mid-point portion of the collation is in engagement with the folding roller assembly. Next, the collation is conveyed through the folding roller assembly to the second fold plate assembly such that the mid-point portion of the collation is caused to be folded in the folding roller assembly, which folded portion is conveyed to, and abuts against the stop member in the second fold plate assembly. The stop member in the second fold plate assembly is then moved from the distal position to proximal position with a signal from the control system so as to cause the collation to convey out of the second fold plate assembly and folding station.

BRIEF DESCRIPTION OF THE DRAWINGS

The above and other objects and advantages of the present invention will become more readily apparent upon consideration of the following detailed description, given by way of example and taken in conjunction with accompanying drawings, in which like reference characters refer to like parts throughout the drawings and in which.

DETAILED DESCRIPTION OF THE PREFERRED EMBODIMENT

Figure 1:
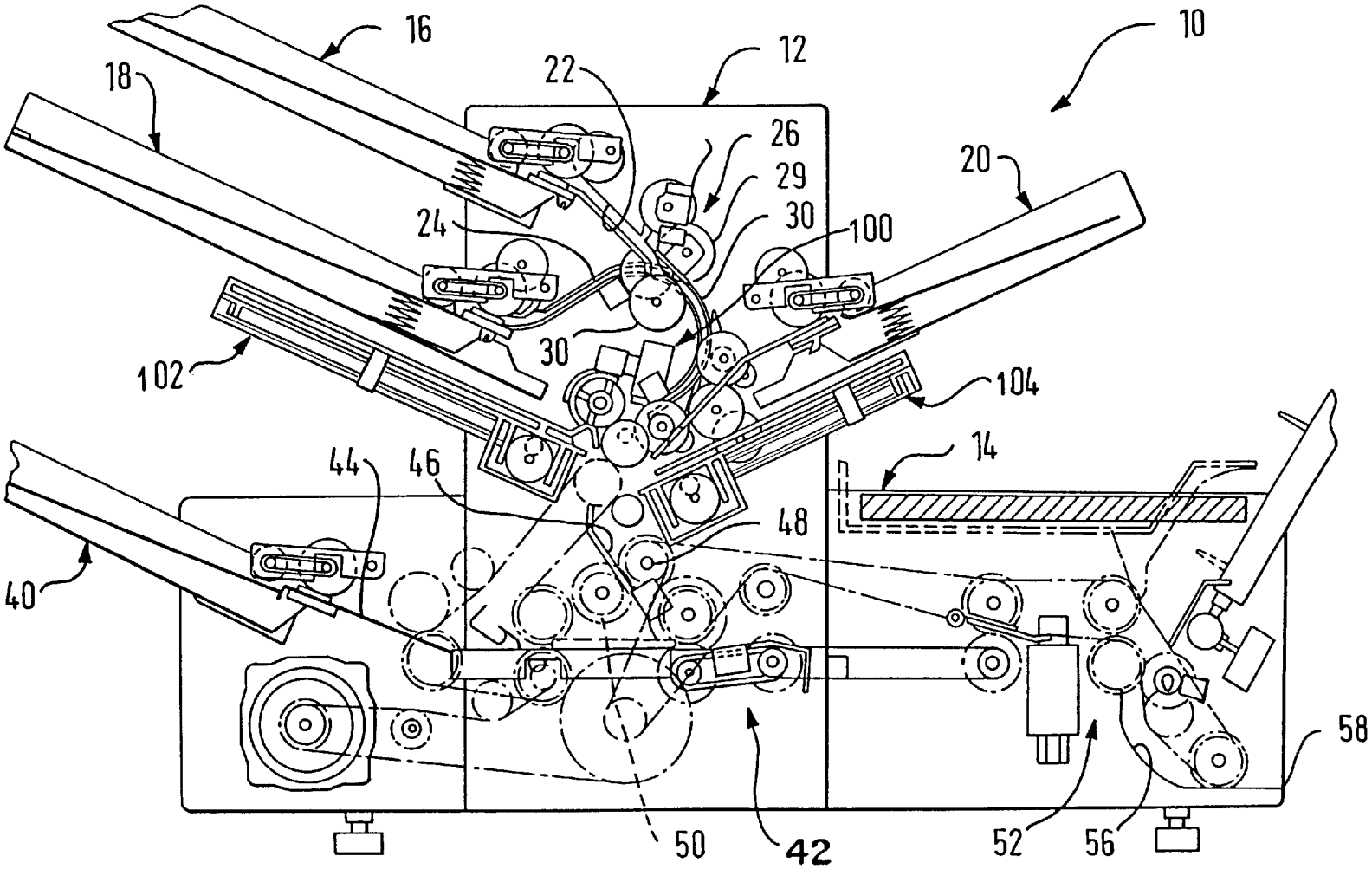
FIG. 1 is an elevational view of a document inserting system in which the present invention folding station is implemented.

In describing the preferred embodiment of the present invention, reference is made to the drawings, wherein there is seen in FIG. 1 an elevational view of a tabletop inserter, designated generally at 10, implementing the present invention folding station, designated generally at 100. It is to be appreciated that reference is made to the inserter system 10 of FIG. 1 only to show an exemplary environment of implementation for the preferred embodiment folding station 100. Thus, inserter system 10 is not to be understood to be the only environment of use for folding station 10 as one skilled in the art could readily implement the below described folding station 100 in various inserter systems requiring a folding station or in any mechanism requiring a folding station for folding sheets of paper. Therefore, in order not to obscure the preferred embodiment folding station 100, only a general description of the inserter system 10 depicted in FIG. 1 will be provided. For a more detailed description, see commonly assigned United Kingdom Patent Application No. 9418333.2 to Ricketts et al., hereby incorporated by reference.

With reference to FIG. 1, tabletop inserter 10 generally consists of an upper housing 12 mounted atop a lower housing 14. Upper housing 12 generally includes first and second sheet feeders 16 and 18, and preferably an insert feeder 20. Individual sheets are preferably conveyed from each sheet feeder 16 and 18 into respectively first and second feed paths 22 and 24. The first and second sheet paths 22 and 24 merge with one another at a collation station 26 having first and second collating rollers 28 and 29. The collation station 26 is operative to align the leading edges of first and second sheets being respectively conveyed from the first and second sheets feeders 16 and 18 (via the first and second sheet paths 22 and 24) within the nip formed between the collating rollers 28 and 29. Once aligned, the collating rollers 28 and 29 are actuated to simultaneously feed the aligned sheets in a supply path 30 downstream of the collating station 26. These aligned sheets are also commonly known as a "collation. " This sheet collation is then conveyed downstream in the supply path 30 to the folding station 100.

Like conventional folding stations, the preferred embodiment folding station 100 is configured to fold a sheet collation in prescribed formats, such as, c-fold, z-fold, half-fold, etc. As will be described in greater detail below, the preferred embodiment folding station 100 half-folds a collation in conjunction a first fold plate 102 and inverts the travel direction of the half-folded collation in a second fold plate 104. After a collation is folded in the folding station 100, the collation is then conveyed to the lower housing 14 of the inserter system 10 for further processing.

The lower housing 14 of inserter system 10 includes an envelope supply station 40 connecting to an insertion station 42. The envelope supply station 40 feeds envelopes to the insertion station 42 (via envelope feed path 44). Once received in the insertion station 42, an envelope is retained in preparation for insertion of the aforesaid folded collation being conveyed from the folding station 100. The folded collation is transported from the folding station 100 to the insertion station 42 via a collation transport path 46 connecting the later two stations. Preferably the collation transport path 46 includes a pair of conveying rollers 48 and 50 for conveying a folded collation along the transport path 46.

The lower housing 14 further includes a sealing station 52 located downstream of the insertion station 42, which sealing station 52 is operative to seal an open envelope received from the insertion station 42. An envelope insertion path connects the insertion station 42 to the sealing station 52. An envelope output path 56 connects to the sealing station 52 and is operative to convey sealed envelopes from the sealing station 52 through an output opening 58 provided in the lower housing 14 of the insertion system 10. After a sealed envelope has exited from the output opening 58 appropriate postage can then be applied for delivery to a recipient.

As is conventional, inserter system 10 includes a control system 70 (FIG. 2) for controlling the various components implemented in the inserter system 10. It is to be appreciated that the control system 70 is to encompass a computer processor driven system.

Figure 2:
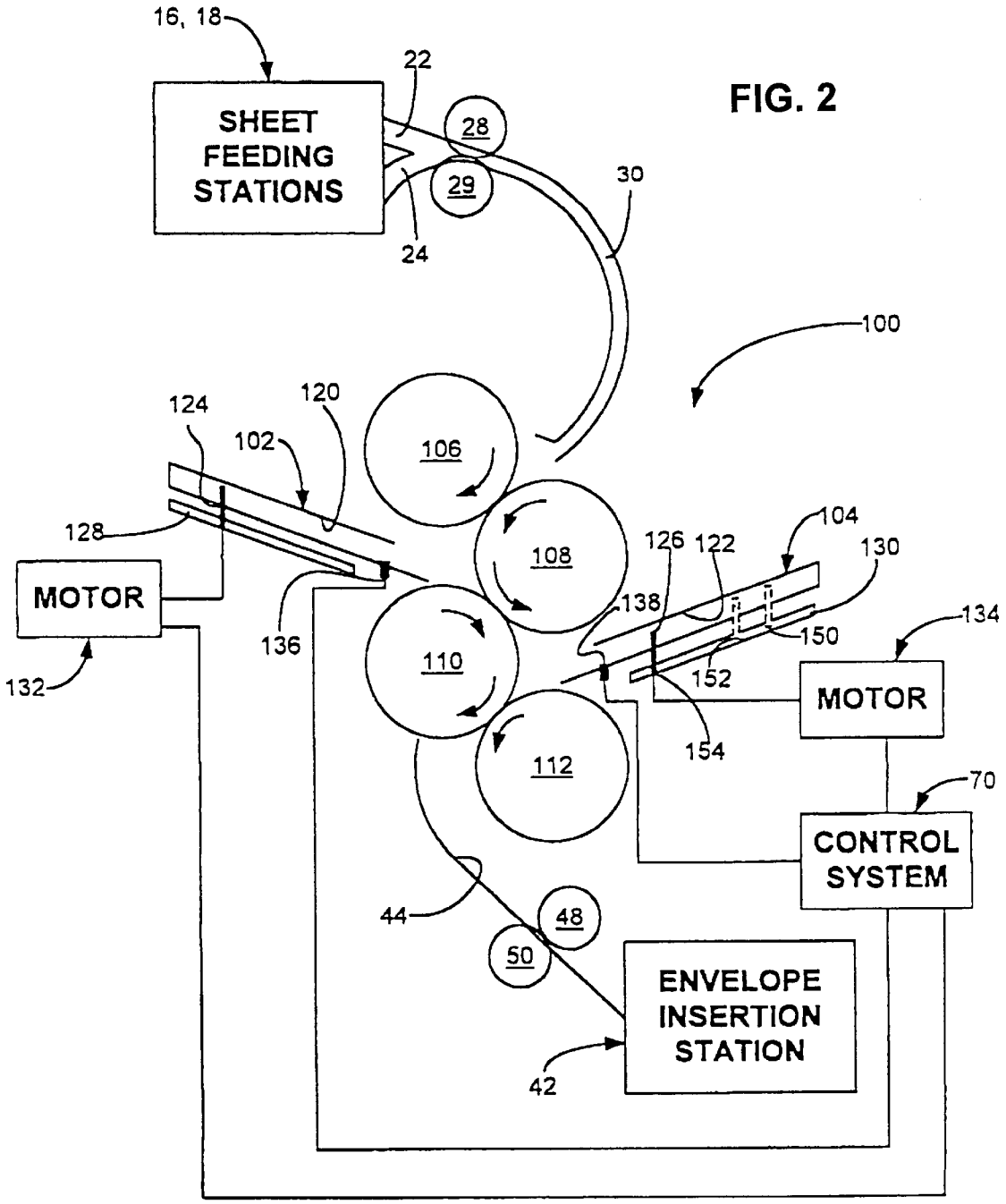
FIG. 2 is a simplified elevational view of FIG. 1 depicting the folding station in accordance with the preferred embodiment.

With the general structure of inserter system 10 being described above, a more specific description will now be given regarding the folding station 100 of the preferred embodiment. With reference to FIG. 2, the folding station 100 includes the first and second folding plates 102 and 104, and first, second, third and fourth folding rollers 106, 108, 110 and 112. Preferably the first and third folding rollers 106 and 110 continuously rotate in a clockwise rotation, while the second and fourth folding rollers 108 and 112 continuously rotate in a counter-clockwise direction. All the later folding rollers preferably rotate at a common speed, which rotation is caused by preferably a AC motor (not shown).

Each folding plate 102 and 104 defines a channel 120 and 122 through which extends a movable stop member 124 and 126. Each stop member 124 and 126 extends from a carriage assembly 128 and 130 and is connected to a respective motor assembly 132 and 134 for moving each respective stop member 124 and 126 through each respective folding plate channel 120 and 122. Each motor assembly 132 and 134 is preferably connected to, and controlled by, the control system 70 of the inserter system 10.

Each folding plate 102 and 104 further includes a sensor element 136 and 138 mounted in proximity to the entrance of each respective fold plate channel 120 and 122. Each sensor 136 and 138 is connected to the control system 70 and is operative to detect the presence of a collation residing above each sensor 136 and 138. It is noted that the sensor 138 in the second folding plate 104 is also operative to signal when an insert is to be fed from an insert station (not shown) so as to be properly nested with the collation in the folding station 100. It is also to be appreciated that depending upon the type of fold that is desired by a user, the control system 70 is operative to position each stop member 124 and 126 in each respective fold plate 102 and 104 at a predetermined position to achieve the chosen fold (e.g., z-fold, c-fold, half-fold, double-fold, etc.). For the purposes of the present invention, described below will be a method for half-folding a collation and then inverting the travel direction of the folded collation in the folding station 100.

Figure 3:
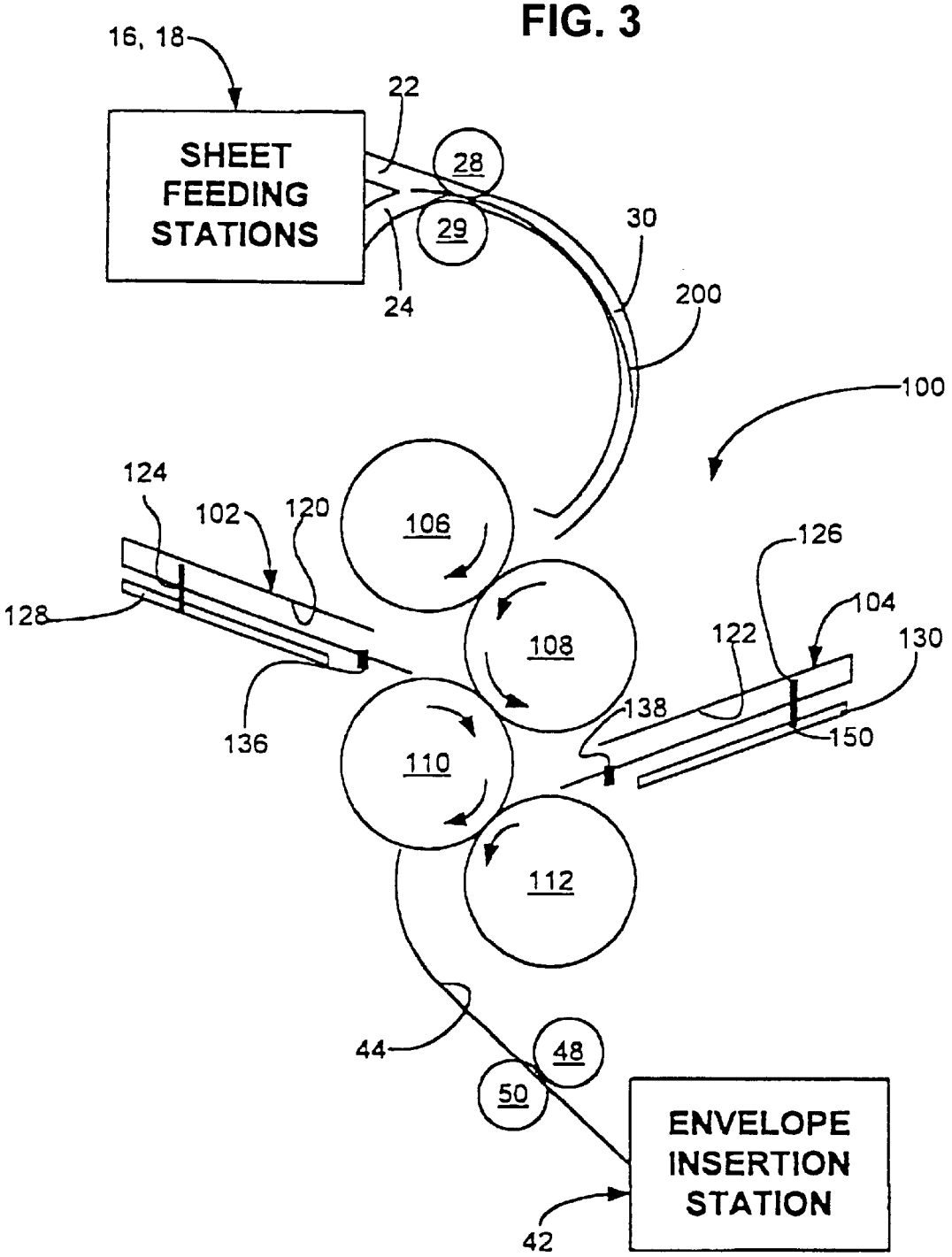
FIG. 3 is an elevational view of FIG. 2 depicting a sheet collation being initially fed from the sheet feeding stations.

With the structure of the inserter system 10, and in particular the folding station 100, being described above, its method of operation for half-folding a collation and inverting its travel direction will now be discussed with reference to FIGS. 3–7 in conjunction with FIG. 2. Referring to FIG. 3, as controlled by the control system 70, the first fold plate stop member 124 is moved in the first fold plate 102 (via motor 132) to a half-fold position to effect a collation to be half-folded by the nip formed between the second and third folding rollers 108 and 110. The second fold plate stop member 126 is moved in the second fold plate 104 (via motor 134) to an entry position 150 that permits a half-folded collation to substantially reside in the folding channel 122 of the second fold plate 104, the significance of which will be appreciated below.

Figure 4:
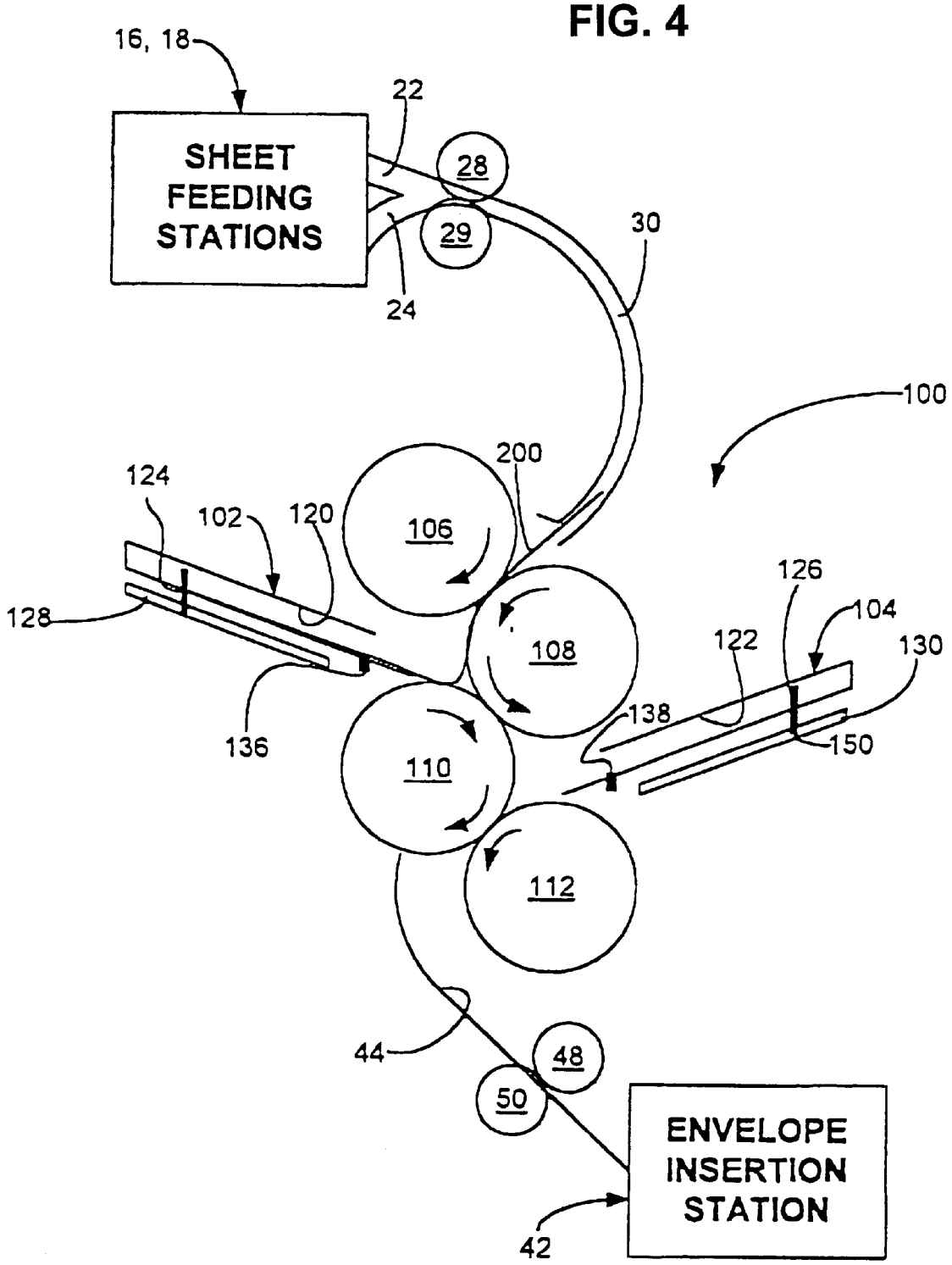
FIG. 4 is an elevational view of FIG. 3 depicting the sheet collation advancing to the first folding assembly.

With continuing reference to FIG. 3, for ease of illustration a single page collation 200 is feed from one of the sheet feeding stations 16 and 18 into the supply path 200 (via rollers 28 and 29). Of course it is to be appreciated that the collation being used in the description of the preferred embodiment is not to be limited to a single page collation but may consist of a plurality of pages being feed from a plurality of sheet feeding stations. Referring now to FIG. 4, the collation 200 is conveyed into the nip formed between the first and second folding rollers 106 and 108. The collation 200 is then caused to advance into the channel 120 of the first folding plate 102. When the leading edge of the collation 200 abuts against the first stop member 124 in the first folding plate 102, the mid-point 202 of the collation 200 will then start to buckle into the nip of the second and third folding rollers 108 and 110 since the first and second folding rollers 106 and 108 are continuing to drive the tail portion of the collation 200.

Figure 5:
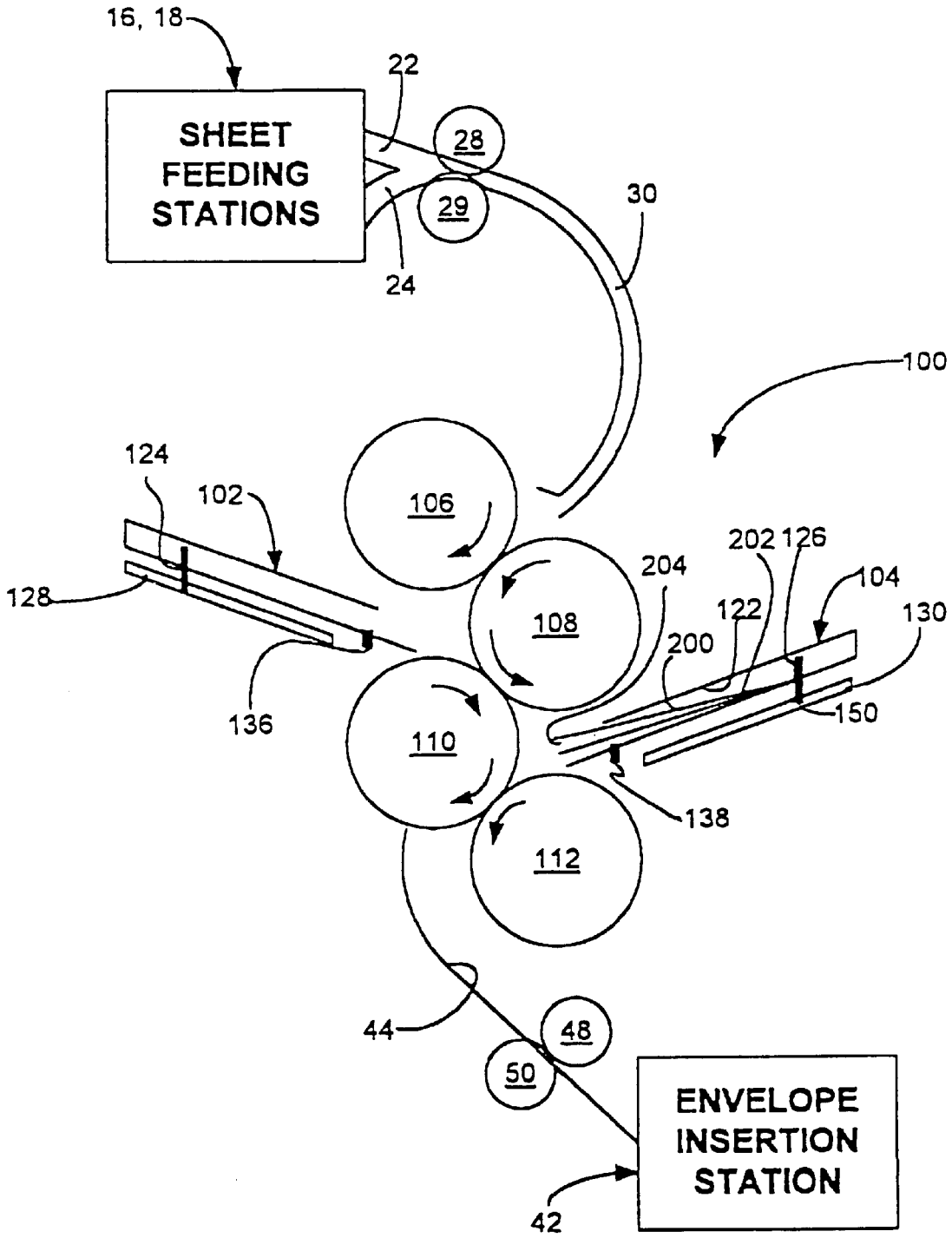
FIG. 5 is an elevational view of FIG. 4 depicting the sheet collation advancing to the second folding assembly.

With reference now to FIG. 5, the mid-point 202 of the collation 200 is then caused to engage into the folding nip of the second and third folding rollers 108 and 110 causing the collation 200 to fold at its mid-point 202 and convey towards and into the second fold plate 104 (via the second and third folding rollers 108 and 110). The folded collation 200 then conveys past the second sensor 138 until the folded leading edge 202 abuts against the second fold plate stop member 126, as shown in FIG. 5. Once the folded leading edge 202 of the collation 200 is in abutment against the second fold plate stop member 126 its open trailing edge 204 preferably resides within the second fold plate 104 with no portion of the collation 200 being in engagement with the nip formed between the third and fourth folding rollers 110 and 112 so as to prevent another fold in the collation 200.

Figure 6:
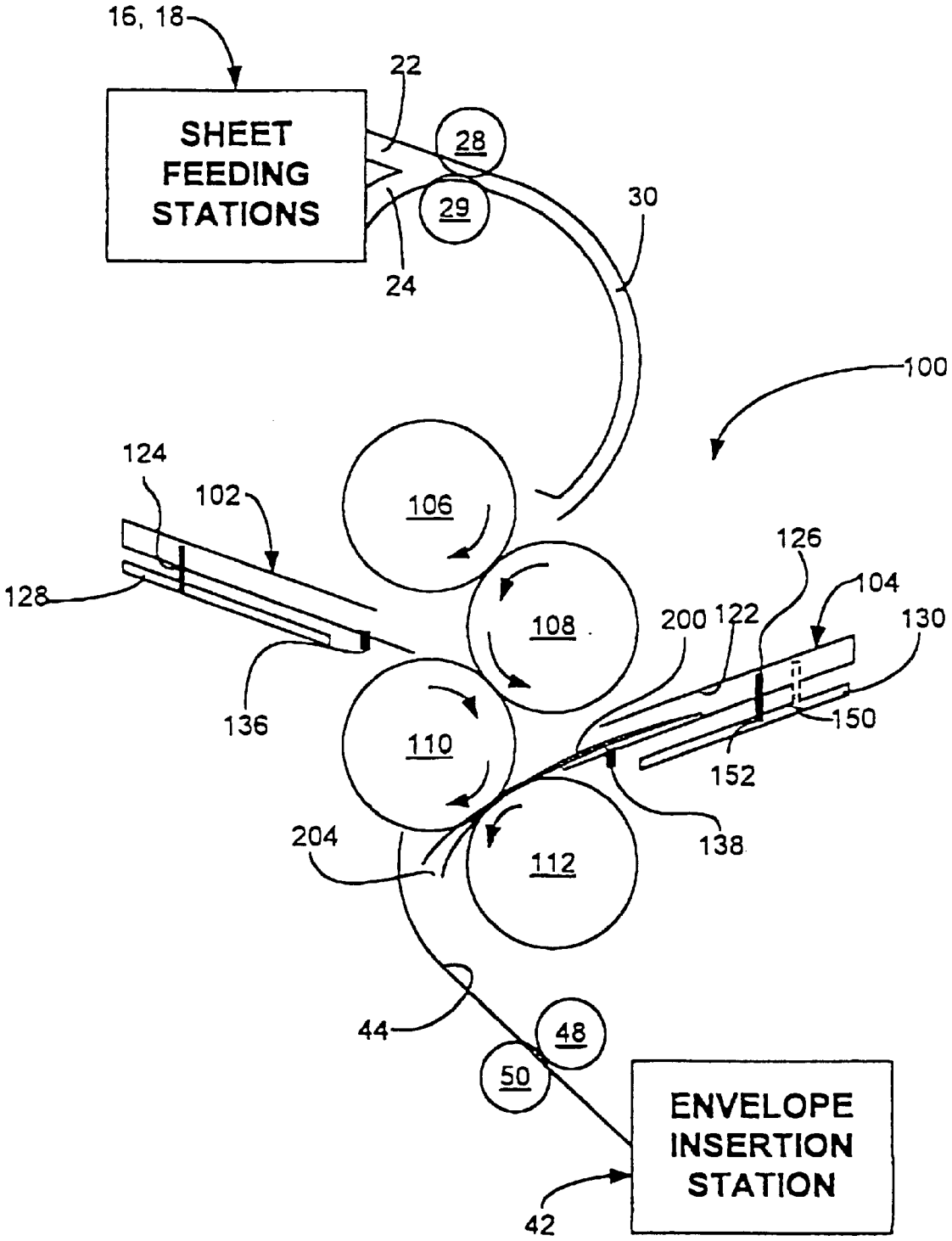
FIG. 6 is an elevational view of FIG. 5 depicting the sheet collation advancing from the second folding assembly.
Figure 7:
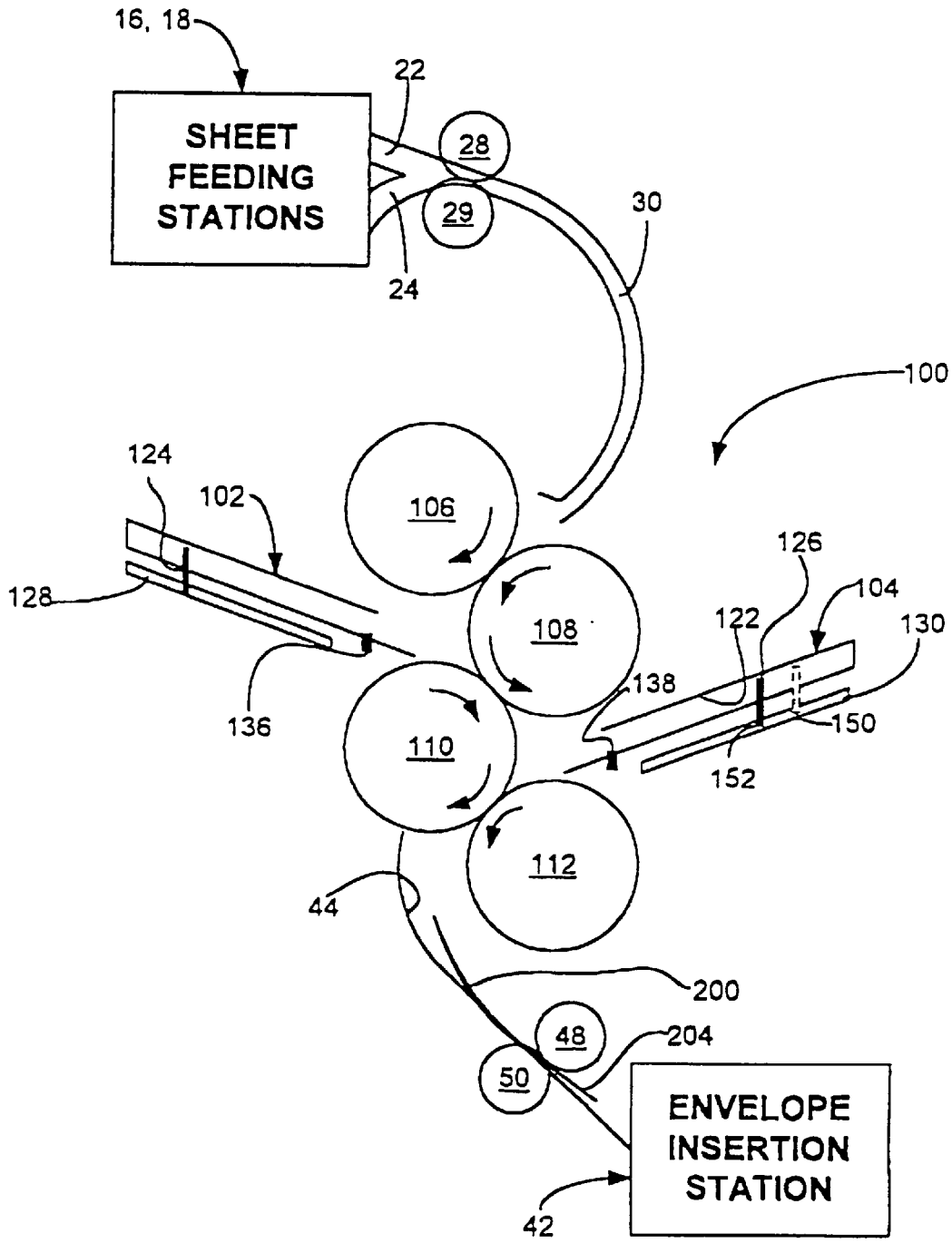
FIG. 7 is an elevational view of FIG. 6 depicting the folded sheet collation advancing from the second folding assembly to an envelope insertion station.

Referring now to FIG. 6, under the control of the control system 70, the second fold plate stop member 126 is caused to convey (via motor 134) toward the third and fourth folding rollers 110 and 112 and toward an engagement position 152 so as to cause the open edge 204 of the folded collation 200 to engage within the nip formed between the third and fourth folding rollers 110 and 112. With reference to FIG. 7, the folded collation 200, with it's open end 204 leading, is then caused to travel along the envelope feed path 44 and into the envelope insertion station 42 (via rollers 48 and 50). Once in the envelope insertion station 42, the folded collation 200 is then preferably inserted into an envelope.

Therefore, the travel direction of the half-folded folded collation 200 is inverted in the second fold plate 104 of the folding station 100. That is, the half-folded collation 200 enters into the second folding plate 104 with its folded edge 202 leading and its open edge 204 trailing, but exits the second folding plate 104, and the folding station 100, with its open edge 204 leading and its folded edge 202 trailing.

With regards to the control of the second fold plate stop member 126 a discussion of its preferred method of operation will not be provided. When the folded edge 202 of the collation is leading and conveying from the second and third folding rollers 108 and 110 and towards the second folding plate 104 (FIG. 5), the leading folded edge 202 first passes over the second sensor 138 as it enters into the second folding plate 104. The second sensor 138 detects that passage of the folded collation 200 in the second folding plate 204 and preferably sends a signal to the control system 70 informing it of the presence of the collation 200. Preferably, after a predetermined pulse count, the controls system 70 sends a signal to the second fold plate stop member 126 (via motor 134) to advance the stop member 126 from its entry position 150 to its engagement position 152 so as to advance the collation 200 out of the second folding plate 104 and toward the nip formed by the third and fourth folding rollers 110 and 112, which rollers convey the collation 200 to the insertion station 42 (via transport path 46). As mentioned above, the folded collation 200 is conveyed out of the second folding plate 104 by the second stop member 126 only after the open trailing edges 204 of the collation have exited from the nip of the second and third folding rollers 108 and 110 so as not to cause another fold in the collation 200.

Afterwards, the second fold plate stop member 126 then preferably advances towards its home position 154 (FIG. 2) whereby the control system 70 resets the stop member 126 to its home calibration position 154, as detected by sensor 138. Thereafter, the second stop member 126 is returned to its entry position 152 (FIG. 3) enabling the control system 70 to ensure that the stop member 126 is in its intended position for inverting the travel direction of another half-folded collation in accordance with the above described method.

In summary, a folding station 100 for half-folding a collation and then changing its travel direction in an mailing inserter system 10 has been described. Although the present invention has been described with emphasis on a particular embodiment, it should be understood that the figures are for illustration of the exemplary embodiment of the invention and should not be taken as limitations or thought to be the only means of carrying out the invention. Further, it is contemplated that many changes and modifications may be made to the invention without departing from the scope and spirit of the invention as disclosed.

What is claimed is:

1. A method for half folding a collation of at least one sheet in a folding station having a folding roller assembly, a first fold plate assembly and a second fold plate assembly downstream of the folding roller assembly and the first fold plate assembly, the method comprising the steps of:

providing a stop member in the second fold plate assembly movable at least between a distal position away from the folding roller assembly and a proximal in proximity to the folding roller assembly;

providing a control system coupled to the stop member in the second fold plate assembly and operative to move the stop member between its distal and proximal positions;

providing a sensing element in the second fold plate assembly and in communication with the control system;

conveying the collation to the first fold plate assembly such that a leading edge portion of the collation is disposed in the first fold plate assembly and a mid-point portion of the collation is in engagement with the folding roller assembly; conveying the collation through the folding roller assembly to the second fold plate assembly such that the mid-point portion of the collation is caused to be folded in the folding roller assembly, which folded portion is conveyed to, and abuts against the stop member in the second fold plate assembly; and sensing entry of the collation in the second fold plate assembly with the sensing element so as to affect the stop member to move from the distal position to the proximal position with a signal from the control system so as to cause the collation to convey out of the second fold plate assembly and folding station.

2. The method as recited in claim 1, further including the step of conveying the half folded collation into the second fold plate assembly such that the half folded collation is autonomous from the folding roller assembly.

3. The method as recited in claim 1, further including the step of returning the stop member in the second fold plate assembly from the proximal position to the distal position with a signal from the control system after the half folded collation conveys out of the second fold plate assembly.

4. The method as recited in claim 1, further including the steps of: providing a movable stop member in the first plate assembly that is coupled to the control system such that a signal from the control system effects positioning of the movable stop member in the first folding plate assembly; and positioning the movable stop member in the first fold plate assembly with a signal from the control system so as to cause a collation to be half folded by the folding roller assembly.

5. The method as recited in claim 1, further including the step of moving the stop member from the distal position to the proximal position after a predetermined amount of time has elapsed from when the sensing element sensed entry of the collation into the second fold plate assembly.

* * * * *